United States Patent [19]

Joyce

[11] 4,336,898

[45] Jun. 29, 1982

[54] CARRIERS FOR CONTAINERS, APPARATUS AND METHOD FOR APPLYING SAME TO CONTAINERS

[76] Inventor: Michael F. Joyce, 25 Rangewood Ave., Kennet Valley, Reading RG3 3NN, Berkshire, England

[21] Appl. No.: 946,124

[22] Filed: Sep. 27, 1978

[51] Int. Cl.[3] ..... B65D 61/00

[52] U.S. Cl. ..... 294/87.28; 220/400; 206/148; 294/87.2

[58] Field of Search ..... 224/45 BA, 45 AB, 45 AA, 224/45 R, 45 A; 294/87.2, 87.28; 206/147, 148, 150, 65 C, 65 E, 65 D; 220/115, 116, 400, 401

[56] References Cited

U.S. PATENT DOCUMENTS

| | | | |
|---|---|---|---|
| 2,854,183 | 9/1958 | Srofe | 294/87.2 X |
| 3,075,799 | 1/1963 | Weiss | 294/87.2 |
| 3,363,928 | 1/1968 | Haufe et al. | 294/87.2 |
| 3,414,313 | 12/1968 | Schwarz | 294/87.2 |
| 3,653,503 | 4/1972 | Arneson | 294/87.2 X |
| 3,701,416 | 10/1972 | Lawrence | 294/87.2 X |

*Primary Examiner*—Joseph J. Rolla

[57] ABSTRACT

This specification discloses a carrier for holding containers having a flange or rim toward an end, the carrier including, a top panel able to lie superimposed over a central part of one side of the flanges to be held and prevent relative displacement of at least one side panel connected to a longitudinal edge of the top panel by a line of hinge, the line of hinge crossing over an outward part of each flange end, the side panel provided with slot cuts each defining an edge of the side panel able to engage the underside of such outward part of the flanges when the side panel is moved angularly toward the containers, the improvement characterized in that the side panel for engaging the flanges is an intermediate single panel stretched tightly around the container below the flanges rather than a clip action which relies upon the resilience of the paperboard alone, or an action which results in the stress resulting from the engagement being divided. Therefore the lower edge of the side panel is hinged to connecting members, the connecting members disposed around a part of the containers to provide a partial socket for them and maintain a tension on the side wall by a hinge attachment of the connecting members to an inside panel which will fix with the underside of the top panel and lay together with the underside of the top panel against the ends of the container flanges. The invention extends to apparatus and blanks for their application in combination with the containers.

8 Claims, 10 Drawing Figures

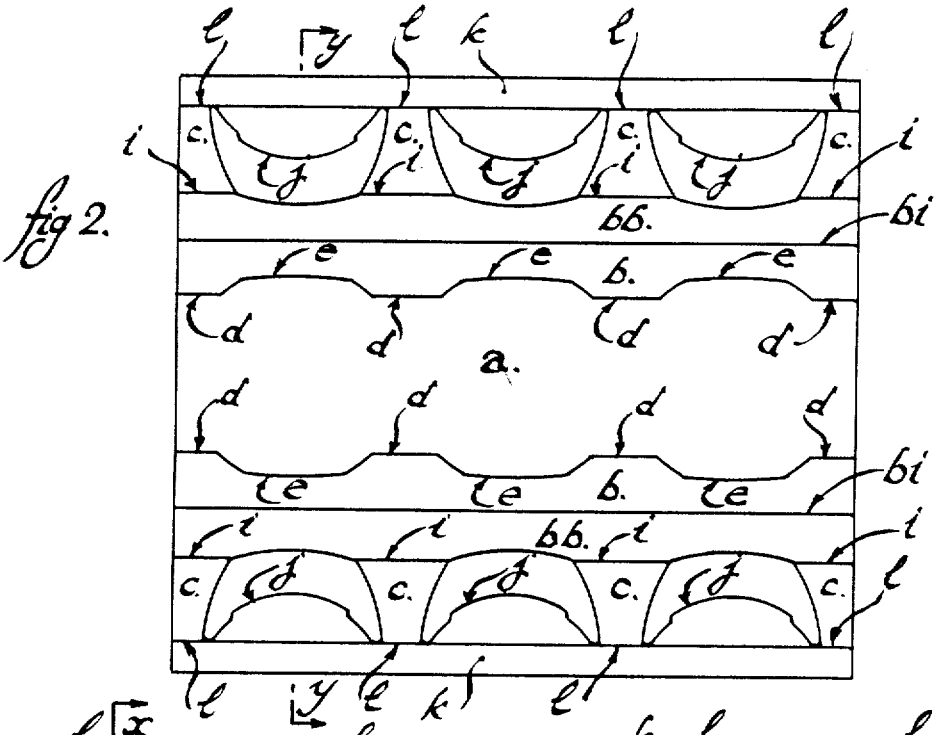
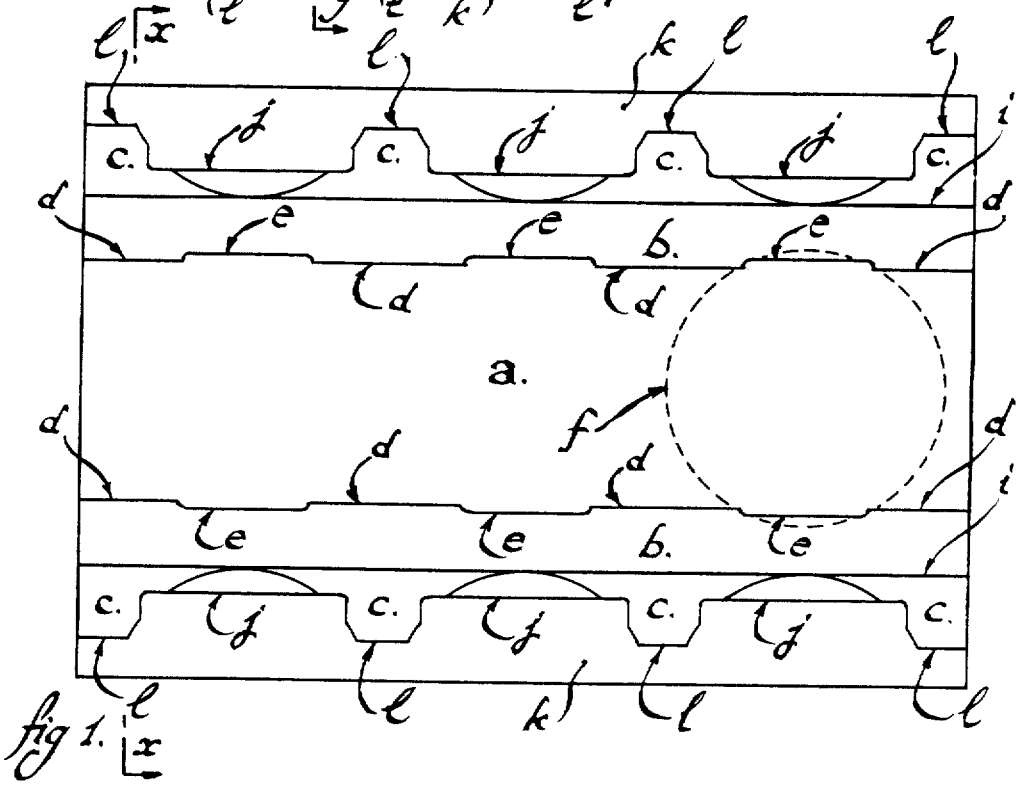
fig 1.

CARRIERS FOR CONTAINERS, APPARATUS AND METHOD FOR APPLYING SAME TO CONTAINERS

BACKGROUND OF THE INVENTION

The invention relates to multipackaging whereby containers are grouped into readily saleable quantities and fixed into a carrier to facilitate handling and carrying by the end purchaser and particularly describes a blank of sheet material, a method and apparatus for application of it to containers for use as a carrier for the containers.

Previously multipacks for flanged containers such as beverage cans, food cans and yogurt tubs have either consisted of a length of paperboard joined to totally surround the containers and which is wasteful of the board. Or in the opposite extreme consisted of only three small paperboard panels joined by two longitudinal folds, a top panel and the side panels. such a top panel able to lie superimposed over one side of a flange which is to be held and prevent relative displacement of a hinge on at least one edge operable with a side panel top edge and said hinge on a line crossing over the superimposed area and there interrupted by lines of cut to define an edge of the side panel able to engage a part of the other side of the flange when the side panel is angled toward the flange.

Such economic multipacks have several disadvantages. Because the outer edge of the board is free it can be caught and lifted to release the container but more importantly, because the side wall's lower edges can move in relation to the container side when the multipack is twisted there is very little resistance to twisting and the container can release. Also because the lower wall edges do not hold the container and the container is held only by the end flange the multipack has no depth of leverage to hold the container whereas the adverse forces for release of the container operate over the full depth of the container when considered axially. Therefore such economic multipacks have been found insufficiently strong to be useful in trade.

It is an object of the present invention to provide an economic carrier wherein the side walls are fixed to form a part of a depth of socket into which the container is fitted by apparatus employing a method for forming the blank around the container into a carrier.

A blank for an economic carrier according to the prior art comprising a substantially rectangular piece of hingable sheet material such as, for example, paperboard divided by longitudinally extending folds for hinge lines into, a panel which forms the carrier top panel with a side panel hinged to one or both longitudinal top panel edges, said side panel having openings to allow a part of a container flange to pass therethrough.

It is an object of the present invention to add to the blank of the art sufficient paperboard for additional holding means for the carrier to be sufficiently strong for it to be useful in trade.

Apparatus for applying the blank according to the prior art was required only to locate the carrier over the containers and fold the side panels against the containers for the opening to allow a part of the container flange to pass therethrough.

It is an object of the present invention to provide apparatus able to prestress the paperboard around the end of the container.

BRIEF SUMMARY OF INVENTION

The improvement in such carriers for containers provided by using a Blank according to the invention supplied flat to a machine including Apparatus for applying the Blank to containers to form a Carrier on the containers.

Accordingly the invention provides a carrier for holding containers having a flange toward an end, the carrier comprising, a top panel able to lie superimposed over a central part of one side of the flanges to be held and prevent relative displacement of at least one side panel connected to a longitudinal edge of the top panel by a line of hinge, the line of hinge crossing over an outward part of each flange end, the side panel provided with slot cuts each defining an edge of the side panel able to engage the under side of such outward part of the flanges when the side panel is moved angularly toward the containers, the improvement characterised in that the said side panel for engaging the flanges is an intermediate single panel of the carrier where the other longitudinal side panel edge is a lower edge hinged to connecting member ends, an inside panel hinged to the connecting member other ends, the connecting members disposed around a part of the containers when the underside of the top panel and the inside are fixed and together overlaying the container flange ends, thereby retaining the lower edge of the side panel with an edge of the side panel engaged with an underside part of the flanges.

Said fixing of the inside panel between the underside of the top panel and the end of the container flanges will be achieved for the inside panel in the inward direction however it is fixed, because it will be withheld by the connecting members therefore it will become fixed laterally in all directions, without the use of adhesive, by an edge portion of the inside panel arranged and adapted to abut with a part of the carrier or a part of the container to prevent outward movement. Where a flange or a container has a particular shape the side panel may be angled or adapted to suit the shape of a container, for instance where the flange does not protrude beyond the wall of the container then the said side panel is adapted to suit the shape by an additional longitudinal line of hinge allowing an edge of the side panel to be angled with the cut edge able to engage the said other side of the flange of the container.

The invention also extends to a Blank for use in forming a carrier for flanged containers comprising, a piece of hingeable sheet material, such as for example a foldable paperboard rectangle, which is divided by prescored longitudinally extending lines of hinge into, a panel which forms the carrier top panel defined on at least one longitudinal edge by a line of hinge connecting the top panel with a side panel, the side panel provided with slot cuts each dimensioned to admit an outer part of a container flange for engagement by a lower edge of the slot cut, when the said line of hinge is superimposed over an outer part of the container flanges and the side panel is moved angularly toward the containers and relative displacement of the top panel is prevented, the improvement characterised in that the said side panel is an intermediate panel of the blank having its other longitudinal edge hinged to one end of connecting members, the sides of which connecting members are defined by apertures corresponding to openings for accommodating a part of the container and each connecting member other end hingeably attaching to a panel forming an inside panel adapted for fixing with the underside of the top panel. Said side panel may be adapted to suit the shape of a container, for instance by a longitudinal line of fold allowing more than one plane.

The invention also extends to apparatus for use in applying blanks of prescored and precut sheet material, such as paperboard, to flanged containers to make carriers holding containers by the combined action of the blanks and the containers and the apparatus comprising, means for folding a hinged side panel of the blank downward of a top panel and inwardly folding connecting members and inside panels dependent from the side panels and depending one from the other, all above and in line with a group of containers arranged for holding in line with their flanges uppermost and able to enter cutouts between the connecting members and below the inside panels when the blank and the containers are moved together, means able to press downwardly upon parts of the side panel or the top panel or their connecting hinge, which parts are not above a container flange, until the side panel is moved further downward toward the containers to its limit and an outer part of the flanges has passed through slots cut in the side panels and an edge of the side panel has engaged below the said outer part of the flange and the said inside panel and the inside of the top panel are against the flange; whereupon the means able to press downwardly and the carrier, made from the blank and holding the containers, are moved apart for the means able to press downwardly to repeat its action on another such blank, folded by the means for folding, and another such group of containers.

Prior arts have made use of such engagement wherein the carrier is a mirror image on each side of a vertical line when the multipack is viewed in end elevation but where the side panel lower edge is free, as previously described, and use has also been made of only one side of the centre line wherein the top panel was hinged on its other side to a panel the full depth of the container and fixed to a similar top panel fitted to the other container end. Similarly the hold of the present invention may be used in the same way i.e. where the invention is one half of the end view without the mirror image.

According to a prefered embodiment of the apparatus there is additionally provided support means for the hinge fold between the side panel and the connecting member, this is to relieve the stress on the connecting member through means pressing downwardly during application of the blank.

BRIEF DESCRIPTION OF DRAWINGS

Embodiments of the invention will now be described by way of example, reference being made to the accompanying drawings in which:

FIG. 1 is a plan view of the blank for a carrier according to the invention shown by FIGS. 5, 6 and 7.

FIG. 2 is a plan view of a blank for a carrier according to the invention shown by FIGS. 8, 9 and 10.

DESCRIPTION OF THE PREFERRED EMBODIMENTS

Figures 3, 4, 5, 6, 7:
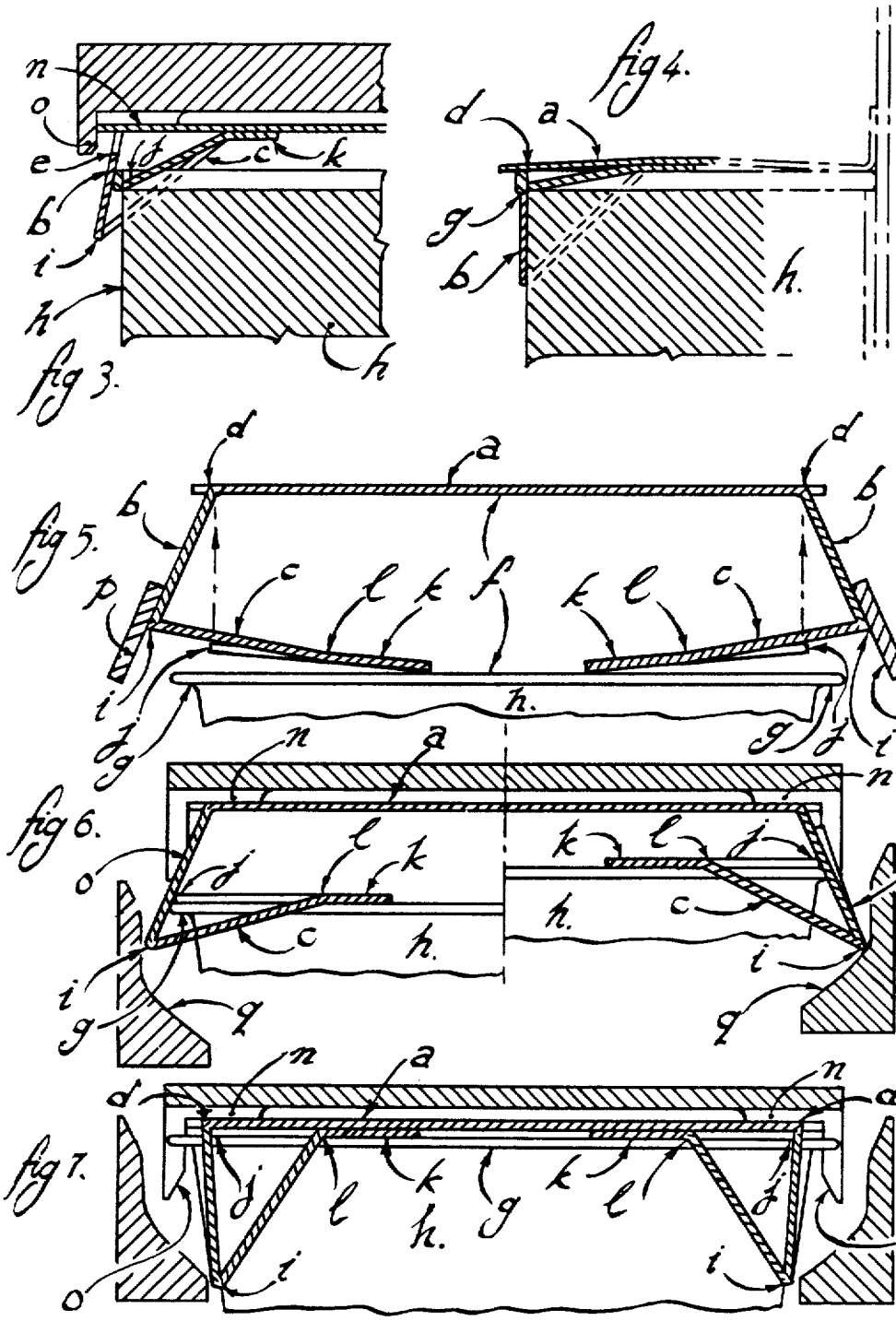
FIG. 3 shows a blank being applied to a part of an externally flanged container by apparatus means for applying it.
FIG. 4 shows the blank shown by FIG. 3 applied to a part of a container.
FIG. 5 shows the blank shown by FIG. 1 in cross section taken on line X—X prepared for application by a part of the apparatus means for applying it.
FIG. 6 shows the blank shown by FIG. 1 in cross section taken on line X—X at an intermediate stage of application on the left hand side of the centre line in mounting a yogurt tub into the blank and a more advanced stage of application of the right hand side of the centre line all in relation to the apparatus means for application.
FIG. 7 shows the blank shown by FIG. 1 in cross section taken on line X—X mounted on a yogurt tub by the apparatus means for applying it and still in contact with the means.
Figure 8:
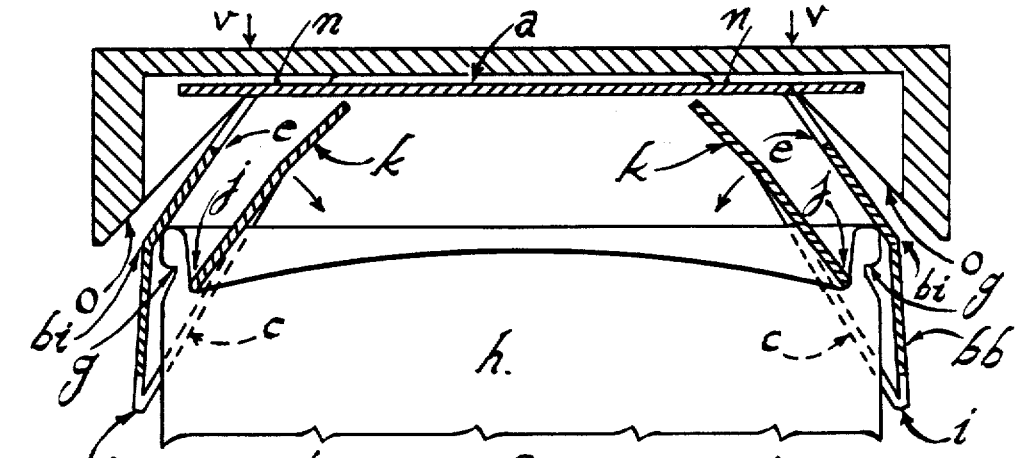
FIG. 8 shows the blank shown by FIG. 1 in cross section taken on line Y—Y at an intermediate stage in mounting a beverage can into the blank by the apparatus means for applying it.
Figure 9:
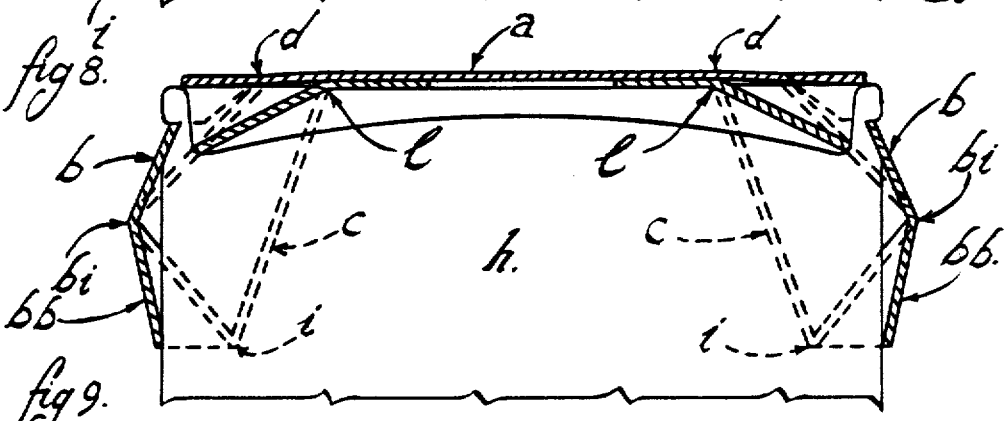
FIG. 9 shows the blank shown by FIG. 2 in cross section on line Y—Y mounted on a beverage can with the apparatus means for applying it removed and the section lines of the blank beyond Y—Y shown by broken lines.
Figure 10:
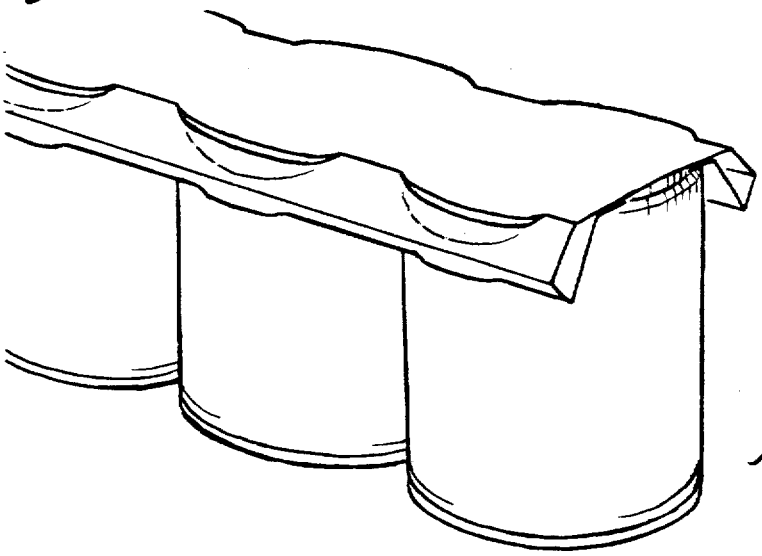
FIG. 10 shows one end of the blank as shown by FIG. 9 seen in perspective as an embodiment of the invention ready for use.

The embodiment shown by FIG. 3 employs a blank related to one half of FIG. 1 divided longitudinally excepting that in detail the part (j) is formed as in FIG. 2 for engagement with a recessed part of the container flange. The blank is shown where the inside panel (k) is turned inwardly above the container with the connecting members (c) entered between the containers, the cuts (e) and the area (f) are centred by guides of the apparatus means (o) over the container (h) which in this figure is an externally flanged can (211 can). The edge (j) has therefore entered the recess of the can flange and continued further movement of surface (n) and (o) of the apparatus means will cause the flange (g) to pass through the opening in the blank and the cut edge (e) of the blank to engage beneath flange (g) by the apparatus surface means (n) pushing down onto the hinge (d) above side panel (b). The part of (d) to which pressure is applied by means (n) does not have a part of the container superimposed, as shown (f), below it therefore the means (n) is able to press the blank slightly lower than its final position for the purpose of overcoming the strong interaction required in the final position between the cut edge (e) and the underside of top panel (a) to stress the blank and resist movement of the flange (g) all as positioned and shown by FIG. 4, thus the means (n) will make (e) free to fully engage below flange (g) under the force of the resilience of panel (b). The side panel (b) will therefore be held against the side of the can (h) and may, in practice, wrap around the can (h) to engage as much of the flange as possible, connecting members (c) will have edges surrounding the can and in contact with it, the inside panel (k) will be trapped between the flange (g) and the inside of the top panel (a), the edge (j) will be firmly engaged with an inside corner of the flange. Such a holding fixture method may be for any purpose but as shown it is connected to a display board which is shown by long and short broken lines to be held against a vertical side of the can thereby providing a helpful resistance to any pull of (a) away from that side of the can. FIG. 5 shows the first stage in the application of an embodiment of the invention wherein the panels described for FIG. 3 and 4 are repeated as a mirror image on each side of the top panel (a) having like reference letters and shown by the blank drawing FIG. 1 wherein a line X—X is the line of section for FIGS. 5, 6 and 7. The inside panels (k) have been turned inwardly with connecting members (c) and there held by a part of the means for application, or by the top of the container. The side panels (b) have been partly turned inwardly and retained by guide means (p) to place the top panel (a) centrally over the container with the cuts (e) above the widest part of the flange. FIG. 6 shows the blank engaged by means for applying the blank and making contact by applicator surface (n) which will apply pressure, and making contact at applicator surface (o) which will ensure that the blank is disposed equally above the container which is shown as a yogurt tub (h). Refering to the left hand side of the centre line, the part (n) has moved the blank down in relation to the tub so that the side panels (b) are in contact with the flange (g). It will be seen that the edge (j) of the inside panel (k) is in contact with the panel (b). The right hand side of the centre line FIG. 6 shows a more advanced stage of application by the means wherein because surfaces (n) and (o) push the blank down by pressure applied onto parts of the blank, which are not within the superimposed area (f) above the tub (h), the side panel (b) is stretched to allow it to be snapped over the rim by continuation of the movement. It is at the same time helpful to prevent excessive pull on the lower hinge (l) by providing a smooth surface (q) shaped for continuous support to the moving hinge (i). FIG. 7 shows the blank locked onto a tub (h) after the hinges (i) have left the support (q) and surface (n) has been therefore able to push onto the hinge (d) above the vertical side panel (b) at a point between tubs for the edge (e) to be free below flange (g) to snap fully home against the tub. It will be seen that the edges (j) are firmly located between the flange (g) and the underside of the top panel (a) and engaged with the inside of panel (b), such change of position is shown by the long and short broken lines in FIG. 5. The carrier is then complete and (n) and (o) are raised for the next operation leaving the blank in the form of a carrier for use. FIG. 8 shows an intermediate stage in the application of an embodiment of the invention in section on line Y—Y shown by FIG. 2 in blank form and wherein the panels are repeated as a mirror image on each side of the top panel (a) having like reference letters. FIG. 8 also shows means for application of the blank for covering it into a carrier for containers and shown by FIGS. 8, 9 and 10 as the Necked-in Beverage Can (or 209 can) which has its flange within a circumferencial recess. As the edge (e) must engage the underside of the flange (g) it is necessary for the side panels (b) to be angled into the recess by dividing each panel by a longitudinal crease (bi) to allow the side panel to bend with a lower part refered to as (bb). In this embodiment the means for application will exert pressure onto the sloping side panel (b) by pressure surface (o) situated around the lower side of edge (e) but a short distance from them and assisted by pressure (n) able to press on parts of the hinge (d) which do not have a part of the can beneath them and for the purpose of stressing the paperboard sufficiently for edges (e) to be free below flange (g) and snap into the recess below (g). As shown by FIG. 8 the blank outer panels are turned inwardly to become the inside panel (k) and form an inverted channel with panels (b/bb) into which the can (h) is guided as the blank descends onto the can with its widest part below the edges (j) which therefore find their way automatically into the recess inside the flange (g) as shown and with the connecting members (c) between the cans. Further movement of (n) applying pressure onto (d) and (a) as described in the direction of the vertical arrows (v) will cause the crease (bi) to bend outwardly and the side panel (b) to stretch to its maximum and snap underneath the flange (g) as described. On reaching the position shown by FIG. 9 the bottom edge of (bb) is stretched around the body (h) and the connecting members (c) have become tightened to pull on hinges (l) by the resistance of (k) through (j) while top panel (a) is resisting the outward pull from its opposite edges (e). In this way the whole of the carrier is prestressed for the greatest resistance to bending or twisting of the blank when applied by the means described and leaving it in the form for use as a carrier with containers according to the invention and shown by FIG. 10. FIG. 10 is without reference letters so that the finished product appearance may be fully understood and that the improvements of ease of handling and of stiffness over prior art forms may be understood as attributable to the closed hollow sections on each side below the engagement with the flange of the can and because said sections provide a surrounding depth of socket in contact with the can. Because the paperboard sheet is dimensioned to be under strain, which reduces the freedom of edges (e) to enter below flange (g), it is prefered that the finished packs should be made to travel between rollers shaped to press the paperboard on each side fully into the recesses below the flange.

It will be understood that all of the features shown and described may be interchanged one with another, and it can be seen that the invention may be carried into effect in a variety of useful forms to carry a variety of flanged containers economically and securely.

I claim:

1. A carrier for holding containers having a flanged end piece, the carrier comprising, a top panel able to lie superimposed over part of the ends of the flanges to be held and prevent relative outward displacement of at least one side panel connected to a longitudinal edge of the top panel by a line of hinge, the line of hinge crossing over an outward part of each flange end, the side panel provided with slot cuts each defining an edge of the side panel able to engage the underside of such outward part of the flanges when the side panel is moved angularly toward the containers, the improvement characterised in that the said side panel for engaging the flanges is an intermediate single thickness panel of the carrier where the other longitudinal side panel edge is a lower edge hinged to connecting member ends, an inside panel hinged to the connecting member other ends, the inside panel having outwardly extending edge portions, each connecting member disposed adjacent a respective container body part of the containers when the underside of the top panel and the inside panel are pressed together and overlaying the container flange ends with the edge portions outwardly extending from the inside panel and contained laterally by their engagement with an inwardly facing part of the containers or carrier side panel, thereby retaining the lower edge of the side panel and its slot cuts each engaging the underside of a container flange.

2. A carrier according to claim 1 wherein the said side panel is adapted to suit the shape of a container by an additional longitudinal line of hinge allowing an edge of the side panel to be angled to engage the said other side of the flange of the container.

3. A carrier according to claims 1 or 2 wherein the construction defined is repeated in mirror image on an opposing longitudinal edge of the sid top panel and the repeated construction is able to engage an opposite flange part of the containers.

4. A blank for forming a carrier for flanged containers according to claim 1 comprising, a piece of hingeable sheet material, such as a foldable paperboard rectangle or the like, which is divided by prescored longitudinally extending lines of hinge into, a panel which forms the carrier top panel defined on at least one longitudinal edge by a line of hinge connecting the top panel with a side panel, the side panel provided with slot cuts each dimensioned to admit an outer part of a container flange, for engagement by a lower edge of the slot out when the said line of hinge is superimposed over an outer part of each container flange end in plan view and the side panel is moved angularly toward the containers and the relative displacement of the top is prevented, the improvement characterised in that the said side panel is an intermediate panel of the blank having its other longitudinal edge hinged to one end of connecting members, the connecting members inner edges defined by apertures intermediate the connecting members, said apertures corresponding to openings for accommodating a respective part of the container body, each connecting member length being dimensioned to allow it to be angled inwardly and being hingeably attached to a panel forming and inside panel, the inside panel having outwardly extending edges dimensioned to be contained laterally by an inwardly facing part of the containers or the carrier side panel when the underside of the top panel and the inside panel are pressed together and overlay the container flange ends with the said slot cuts each engaging the underside of a respective container flange.

5. A blank for forming a carrier for flanged containers according to claim 4 wherein the said side panel has an additional longitudinal line of fold to allow the lower edge of the slot cuts to be angled to engage an outer part of the flange of the containers.

6. A blank for forming a carrier for flanged containers according to claims 4 or 5 wherein the construction of the blank defined is repeated substantially in mirror image from a connecting hinge on an opposite longitudinal edge of the said top panel for engaging an opposite flange part of the containers.

7. Apparatus for applying blanks for carriers according to claim 1 formed of prescored and precut sheet material, such as paperboard or the like, to flanged containers to make carriers holding containers by the combined action of the blanks and the containers comprising, means for folding a hinged side panel of the blank downward of a top panel and inwardly folding connecting members and inside panels dependent from the side panels and depending one from the other ready to admit a group of the flanged containers and positioned above and in line with the group of containers arranged in the position in which they are to be held with their flanges uppermost and able to enter apertures intermediate the connecting members below the inside panels and between the side panels when the blank and the containers are moved together, means able to press downwardly upon parts of the side panel, the top panel, or their connecting hinge, which parts are not above a container flange, until the side panel is moved further downward toward the containers to its limit, an outer part of each flange has passed through a respective slot cut in the side panels, an edge of the side panel has engaged below the said outer part of the flange and the said inside panel and the inside of the top panel are against the flange with the outwardly extending edge portions of the top panel engaging and contained by inwardly facing parts of the containers or carrier side panels; whereupon the means able to press downwardly and the carrier, made from the blank and holding the containers, are moved apart for the means able to press downwardly to repeat its action on another such blank folded by the means for folding and another such group of containers.

8. Apparatus for applying blanks according to claim 7 including smooth surface means for supporting the hinge between the side panel and the connecting members during application, said surface shaped to conform substantially with the path followed by said hinge during application, whereby strain on the hinge is relieved.

* * * * *